US010355342B2

(12) United States Patent
Moon et al.

(10) Patent No.: US 10,355,342 B2
(45) Date of Patent: Jul. 16, 2019

(54) OMNIDIRECTIONAL ANTENNA FOR MOBILE COMMUNICATION SERVICE

(71) Applicant: KMW INC., Hwaseong, Gyeonggi-do (KR)

(72) Inventors: Young-Chan Moon, Suwon (KR); Oh-Seog Choi, Suwon (KR); In-Ho Kim, Yongin (KR); Hyoung-Seok Yang, Hwaseong (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 202 days.

(21) Appl. No.: 15/438,397

(22) Filed: Feb. 21, 2017

(65) Prior Publication Data

US 2017/0170550 A1 Jun. 15, 2017

Related U.S. Application Data

(63) Continuation of application No. PCT/KR2015/007548, filed on Jul. 21, 2015.

(30) Foreign Application Priority Data

Aug. 22, 2014 (KR) ..... 10-2014-0109486

(51) Int. Cl.
*H01Q 9/34* (2006.01)
*H01Q 1/24* (2006.01)
(Continued)

(52) U.S. Cl.
CPC ..... *H01Q 1/246* (2013.01); *H01Q 1/36* (2013.01); *H01Q 1/48* (2013.01); *H01Q 9/065* (2013.01);
(Continued)

(58) Field of Classification Search
CPC ..... H01Q 1/246; H01Q 1/36; H01Q 1/48; H01Q 9/065
(Continued)

(56) References Cited

U.S. PATENT DOCUMENTS 4,062,019 A 12/1977 Woodward et al.
4,899,162 A * 2/1990 Bayetto ..... H01Q 21/205 343/700 MS
(Continued)

FOREIGN PATENT DOCUMENTS

JP 11-284433 A 10/1999
JP 11-330850 A 11/1999
(Continued)

OTHER PUBLICATIONS

"Broadband Umnidirectional Antennas", A Dissertation Submitted for the Degree of Doctor of Philosophy, Quau Xulin; Information technology I136-1.
(Continued)

*Primary Examiner* — Huedung X Mancuso
(74) *Attorney, Agent, or Firm* — Mintz Levin Cohn Ferris Glovsky and Popeo, P.C.; Kongsik Kim; Jhongwoo Jay Peck

(57) ABSTRACT

The present invention relates to an omnidirectional antenna for a mobile communication service, comprising: a plurality of radiation elements disposed on a horizontal surface with a mutually same angle so as to respectively radiate beams; and a power supply unit for distributing and providing a power supply signal to each of the plurality of radiation elements, wherein each of the plurality of radiation elements has a structure in which a horizontal polarization dipole radiation unit having two radiation arms is coupled to a vertical polarization dipole radiation unit having two radiation arms.

16 Claims, 21 Drawing Sheets

(51) Int. Cl.

| | |
|---|---|
| ***H01Q 1/36*** | (2006.01) |
| ***H01Q 1/48*** | (2006.01) |
| ***H01Q 9/06*** | (2006.01) |
| ***H01Q 9/18*** | (2006.01) |
| ***H01Q 21/24*** | (2006.01) |
| ***H01Q 9/28*** | (2006.01) |
| ***H01Q 21/20*** | (2006.01) |
| ***H01Q 21/26*** | (2006.01) |

(52) U.S. Cl.
CPC ..... *H01Q 9/18* (2013.01); *H01Q 9/285* (2013.01); *H01Q 21/205* (2013.01); *H01Q 21/24* (2013.01); *H01Q 21/26* (2013.01)

(58) Field of Classification Search
USPC ..... 343/874
See application file for complete search history.

(56) References Cited

U.S. PATENT DOCUMENTS

| | | | | |
|---|---|---|---|---|
| 5,872,547 | A * | 2/1999 | Martek | H01Q 1/246 342/375 |
| 5,986,610 | A * | 11/1999 | Miron | H01Q 1/243 343/702 |
| 6,366,254 | B1 * | 4/2002 | Sievenpiper | H01Q 1/3275 343/770 |
| 8,427,385 | B2 | 4/2013 | Payne | |
| 9,246,236 | B2 | 1/2016 | Lecam et al. | |
| 2017/0040702 | A1 * | 2/2017 | West | H01Q 11/105 |

FOREIGN PATENT DOCUMENTS

| | | | |
|---|---|---|---|
| JP | 2009044207 | A | 2/2009 |
| JP | 2013501461 | A | 1/2013 |
| JP | 2013530643 | A | 7/2013 |
| KR | 10-2009-0071316 | A | 7/2009 |
| KR | 10-2011-0134005 | A | 12/2011 |
| KR | 10-2013-0025134 | A | 3/2013 |
| KR | 10-2013-0035052 | A | 4/2013 |
| KR | 10-2014-0007391 | A | 1/2014 |

OTHER PUBLICATIONS

English language translation summary of Chinese Office Action dated Oct. 8, 2018 issued in counterpart Chinese Application No. 201580044964.9.

* cited by examiner

OMNIDIRECTIONAL ANTENNA FOR MOBILE COMMUNICATION SERVICE

CROSS REFERENCE TO RELATED APPLICATIONS

This application is a continuation of an International Application No. PCT/KR2015/007548 filed on Jul. 21, 2015, which claims priority to Korean Patent Application No. 10-2014-0109486 filed on Aug. 22, 2014, the entire disclosures of which are incorporated herein by reference.

TECHNICAL FIELD

The present invention relates to an antenna that is applicable to a base station or a relay station in a mobile communication (PCS, cellular, CDMA, GSM, LTE, or the like) network, and in particular, to an omnidirectional antenna.

BACKGROUND ART

An omnidirectional antenna, called a non-directional antenna, is an antenna designed to radiate electromagnetic waves uniformly all around 360 degrees in the horizontal direction. In a mobile communication network, it is impossible to predict a direction where a mobile communication terminal moves due to a characteristic thereof. Thus, the mobile communication terminal is typically provided with an omnidirectional antenna that employs a circular monopole antenna structure. An antenna installed in a mobile communication network base station or relay station is usually provided with a directional antenna for directing each service range divided into three sectors.

Recently, as the Long Term Evolution (LTE) service has become more popular, it is required to construct a small cell or an ultra-small cell equipment for ensuring a smooth service in a shaded area, such as the inside of a building, and also for increasing a data transmission speed. Small cells for outdoor use are serviced at a coverage of 0.5 to 1.5 km, and a small size is also required for the equipment itself. Thus, as an antenna applied to the corresponding equipment, it may be useful to adopt an omnidirectional antenna.

A commonly used omnidirectional antenna mainly uses single polarization (V-pol). However, a MIMO (Multi Input Multi Output) technology is inevitable for the LTE service, and a dual polarization antenna is indispensable for this purpose. In an omnidirectional antenna, a conventional dual polarization means an H-polarization (H-pol; 0 degrees) and a vertical polarization (V-pol; 90 degrees).

However, a +/−45 degree dual polarization has the lowest correlation between the two polarizations in terms of the reflection or diffraction of radio waves due to fading. Thus, a directional antenna, which is usually applied to the base station or the relay station, mainly uses the +/−45 degree dual polarization. Accordingly, studies have been made to generate the +/−45 degree dual polarization even in an omnidirectional antenna. However, it is difficult to implement a structure for generating the +/−45 degree dual polarization while satisfying omni-directionally even radiation characteristics. Furthermore, it is more difficult to implement an omnidirectional antenna in a small size in consideration of the fact that it is installed in a small cell, such as inside a building, while generating the +/−45 degree dual polarization.

SUMMARY

Accordingly, an object of the present invention is to provide an omnidirectional antenna for a mobile communication service, which is capable of generating a +45 degree or −45 degree polarization while satisfying excellent omnidirectional radiation characteristics.

Another object of the present invention is to provide an omnidirectional antenna for a mobile communication service, which is capable of generating a +/−45 degree dual polarization.

Still another object of the present invention is to provide an omnidirectional antenna for a mobile communication service, which is capable of generating a +/−45 degree dual polarization while implementing the omnidirectional antenna in a small size.

In order to achieve the above-described objects, according to an aspect of the present invention, there is provided an omnidirectional antenna for a mobile communication service, which includes: a plurality of radiation elements arranged on a horizontal plane with a mutually identical angle so as to radiate beams, respectively; and a power supply unit that distributes and provides feeding signals to each of the plurality of radiation elements. Each of the plurality of radiation elements has a structure in which a horizontal polarization dipole radiation unit having two radiation arms and a vertical polarization dipole radiation unit having two radiation arms are coupled to each other.

Each of the plurality of radiation elements may be formed through a pattern printing manner using a Flexible Printed Circuit Board (FPCB).

The plurality of radiation elements may be successively arranged on the FPCB at a predetermined interval, and the FPCB may be provided in a cylindrical shape.

Each of the plurality of radiation elements may have a structure in which one radiation arm and the other radiation arm of the horizontal polarization dipole radiation unit are connected to one radiation arm and the other radiation arm of the vertical polarization dipole radiation unit, respectively, at the center of the corresponding radiation element, or the one radiation arm and the other radiation arm of the horizontal polarization dipole radiation unit are connected to the other radiation arm and the one radiation arm of the vertical polarization dipole radiation unit, respectively, at the center of the corresponding radiation element. A design may be made such that power is simultaneously supplied to the portions where the horizontal polarization dipole radiation pattern and the vertical polarization dipole radiation pattern are connected.

According to another aspect of the present invention, there is provided an omnidirectional antenna for a mobile communication service, which includes: a plurality of radiation element arrays each including a plurality of radiation elements arranged on a horizontal plane with a mutually identical angle so as to radiate beams, respectively, the radiation element arrays being successively arranged in a vertical direction; and a feeding unit that distributes and provides feeding signals to each of the plurality of radiation element arrays. Each of the plurality of radiation elements of each of the plurality of radiation element arrays may have a structure in which a horizontal dipole radiation unit having two radiation arms and a vertical polarization dipole radiating part having two radiation arms are coupled to each other.

Each of the plurality of radiation element arrays is configured with first type radiation elements in which each of the plurality of radiation elements has a structure in which one radiation arm and the other radiation arm of the horizontal polarization dipole radiation unit are connected to one radiation arm and the other radiation arm of the vertical polarization dipole radiation unit, respectively, at the center of the corresponding radiation element, or configured with second type radiation elements in which the one radiation arm and the other radiation arm of the horizontal polarization dipole radiation unit are connected to the other radiation arm and the one radiation arm of the vertical polarization dipole radiation unit, respectively, at the center of the corresponding radiation element. A design may be made such that power is simultaneously supplied to the portions where the horizontal polarization dipole radiation pattern and the vertical polarization dipole radiation pattern are connected.

In each of the plurality of radiation element arrays, the plurality of radiation elements may be simultaneously formed through a pattern printing manner using one FPCB.

In each of the plurality of radiation element arrays, the plurality of radiation elements are constituted by first to third radiation elements, and the FPCB on which the first to third radiation elements are formed may be provided in a cylindrical structure.

The plurality of radiation element arrays may have a combination structure of at least one radiation element array configured with the first type radiation elements and at least one radiation element array configured with the second type radiation elements.

The plurality of radiation element arrays have a structure in which the first to fourth radiation element arrays are successively arranged in the vertical direction, the first and second radiation element arrays are configured with the first type or second type radiation elements, and the third and fourth radiation element arrays are configured with radiation elements of which the type are different from that of the first and second radiation element arrays.

The feeding unit that distributes and provides feeding signals to each of the plurality of radiation element arrays may include a plurality of feeding boards having a feeding pattern that provides a feeding signal to each of the plurality of radiation element arrays, and each of the plurality of feeding boards includes an inner layer; a feeding pattern formed on a top surface of the inner layer and having a plurality of coupling feeding patterns that respectively supply power to the plurality of radiation elements formed on a corresponding radiation element array in a coupling manner; and a ground pattern formed on a bottom surface of the inner layer.

Each of the plurality of feeding boards may be fed with power through a plurality of feeding lines, respectively, at least one connection passage through which at least one of the feeding lines, which feed power to different feeding boards, passes may be formed in a form of a through hole, and the feeding line passing through the connection path may be soldered to the ground pattern.

BRIEF DESCRIPTION OF THE DRAWINGS

The above and other aspects, features, and advantages of the present invention will be more apparent from the following detailed description taken in conjunction with the accompanying drawings, in which.

DETAILED DESCRIPTION

Hereinafter, embodiments of the present invention will be described in detail with reference to the accompanying drawings. In the following description, specific features, such as specific components, are illustrated merely for helping the general understanding of the present invention. It will be obvious to a person ordinarily skilled in the art that certain modifications or changes may be made to the specific features without departing from the scope of the present invention.

Figure 1:
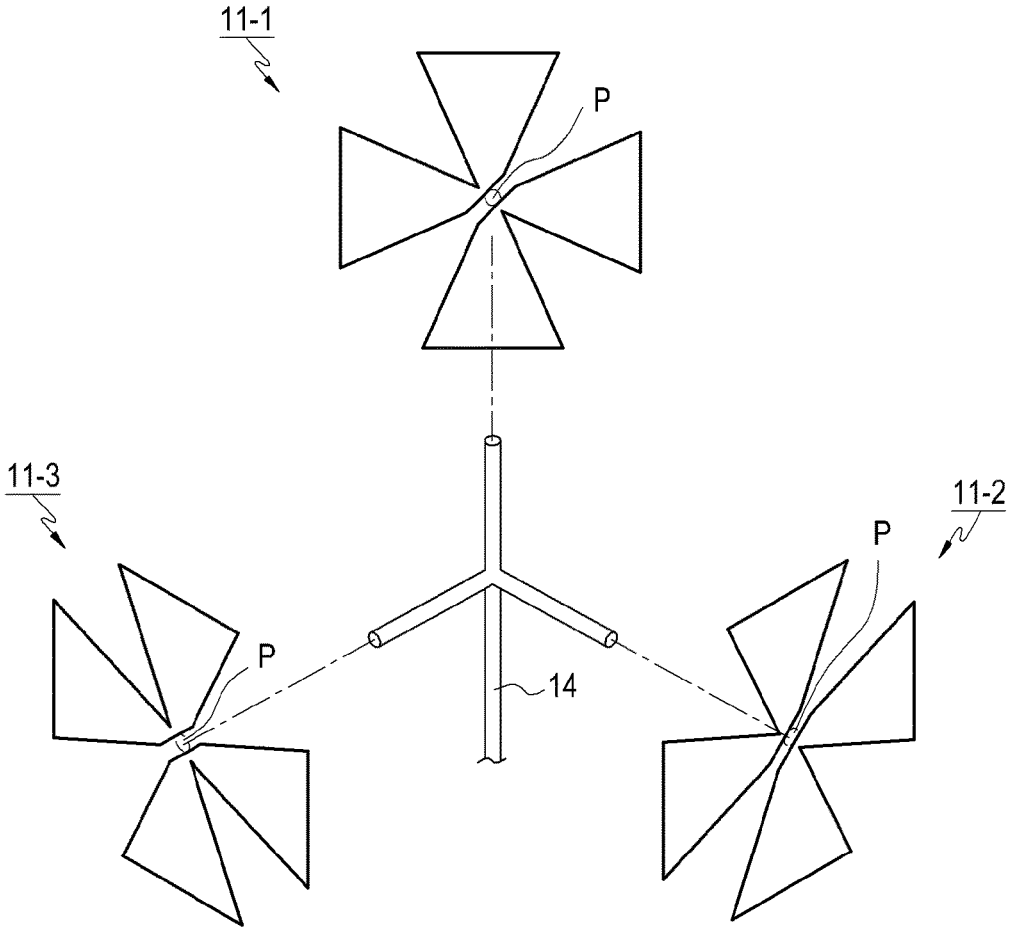
FIG. 1 is a schematic exploded view illustrating a structure of an omnidirectional antenna for a mobile communication service according to a first embodiment of the present invention.
Figure 2:
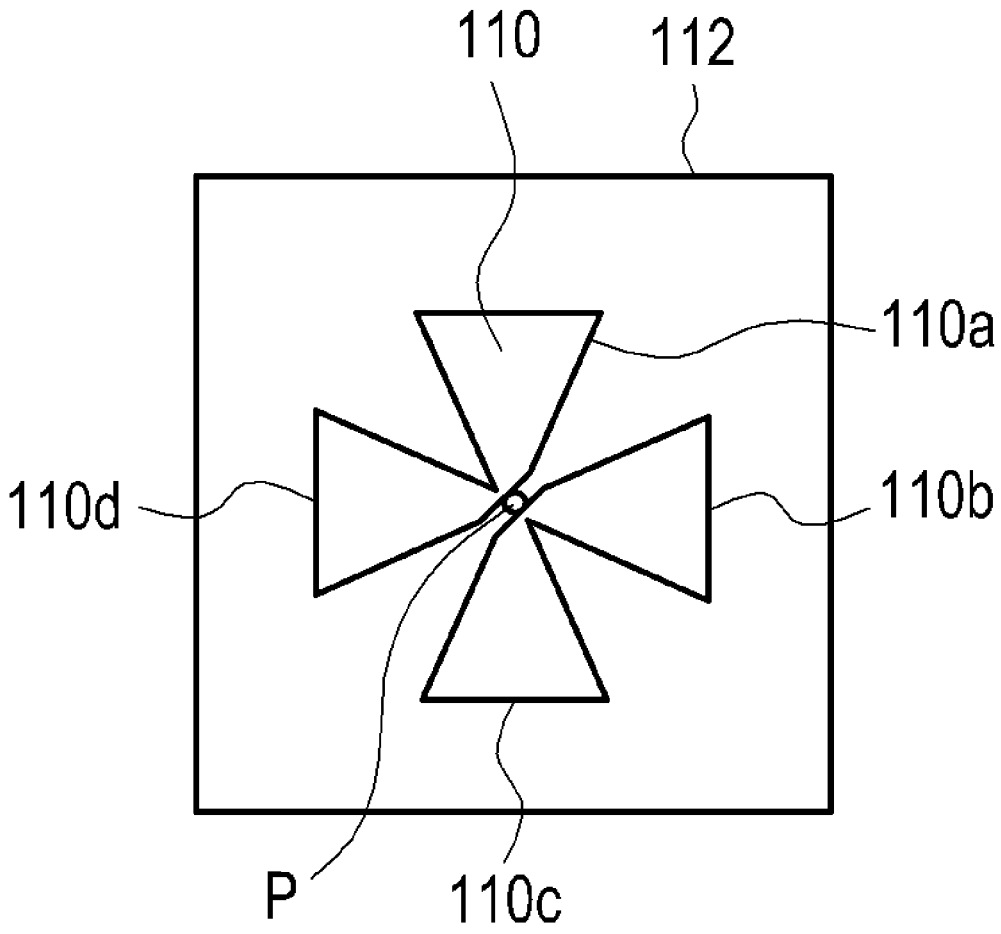
FIG. 2 is a view illustrating a first type structure of a radiation element of FIG. 1.

FIG. 1 is a schematic exploded view illustrating a structure of an omnidirectional antenna for a mobile communication service according to a first embodiment of the present invention, and FIG. 2 is a view illustrating a first type structure of each of first to third radiation elements. Referring to FIGS. 1 and 2, an omnidirectional antenna according to the present invention may be implemented in a combination structure of, for example, three radiation elements (i.e., first to third radiation elements 11 (11-1, 11-2, and 11-3).

Referring to FIGS. 1 and 2, each of the radiation patterns 110 of the first to third radiation elements 11 has a combination structure of a horizontal polarization (H-pol) radiation unit having two radiation arms 110*b* and 110*d* and a vertical polarization (V-pol) dipole radiation unit having two radiation arms 110*a* and 110*c*. At this time, in each of the radiation elements 11, the one radiation arm 110*d* of the horizontal polarization dipole radiation unit and the one radiation arm 110*a* of the vertical polarization dipole radiation unit are connected to a feeding point P positioned at the center of the radiation element 110, and the other radiation arm 110*b* of the horizontal polarization dipole radiation unit and the other radiation arm 110*c* of the vertical polarization dipole radiation unit are connected to each other at a portion corresponding to the feeding point P.

That is, the one radiation arm 110*d* of the horizontal polarization dipole radiation unit and the one radiation arm 110*a* of the vertical polarization dipole radiation unit are integrally provided as a pair, and the other radiation arm 110*b* of the horizontal polarization dipole radiation unit and the other radiation arm 110*c* of the vertical polarization dipole radiation unit are integrally provided as a pair.

Referring to the configuration of a feeding unit that provides a feeding signal to each radiation element 11, the feeding point P of each radiation element 11 is connected to a feeding line 14 (see, e.g., FIG. 1) to be fed with power. The feeding unit is designed such that a connection part where the one radiation arm 110*d* of the horizontal polarization dipole radiation unit and the one radiation arm 110*a* of the vertical polarization dipole radiation unit are connected to each other and a connection part where the other radiation arm 110*b* of the horizontal polarization dipole radiation unit and the other radiation arm 110*c* of the vertical polarization dipole radiation unit are connected to each other are simultaneously fed with power through the feeding point P.

The radiation patterns of each of the first to third radiation elements 11 may be made by forming a thin metal plate (e.g., a copper plate). In addition, as illustrated in the example of FIG. 2, each of the radiation patterns may be implemented by a circuit pattern through a pattern printing method using a Flexible Printed Circuit Board (FPCB) 112.

Here, descriptions will be made, by way of an example, with reference to a technology in which the plurality of radiation elements 11 are implemented on the FPCB. The plurality of radiation elements may be formed using a copper plate bent in a circular or oval shape without being limited to the PCB. Instead of the FPCB, a conventional flat PCB may be formed in a polygonal shape, such as a triangular shape or a quadrangular shape, to dispose a plurality of radiation elements thereon. One or more radiation elements may be disposed on each flat PCB.

Figure 3:
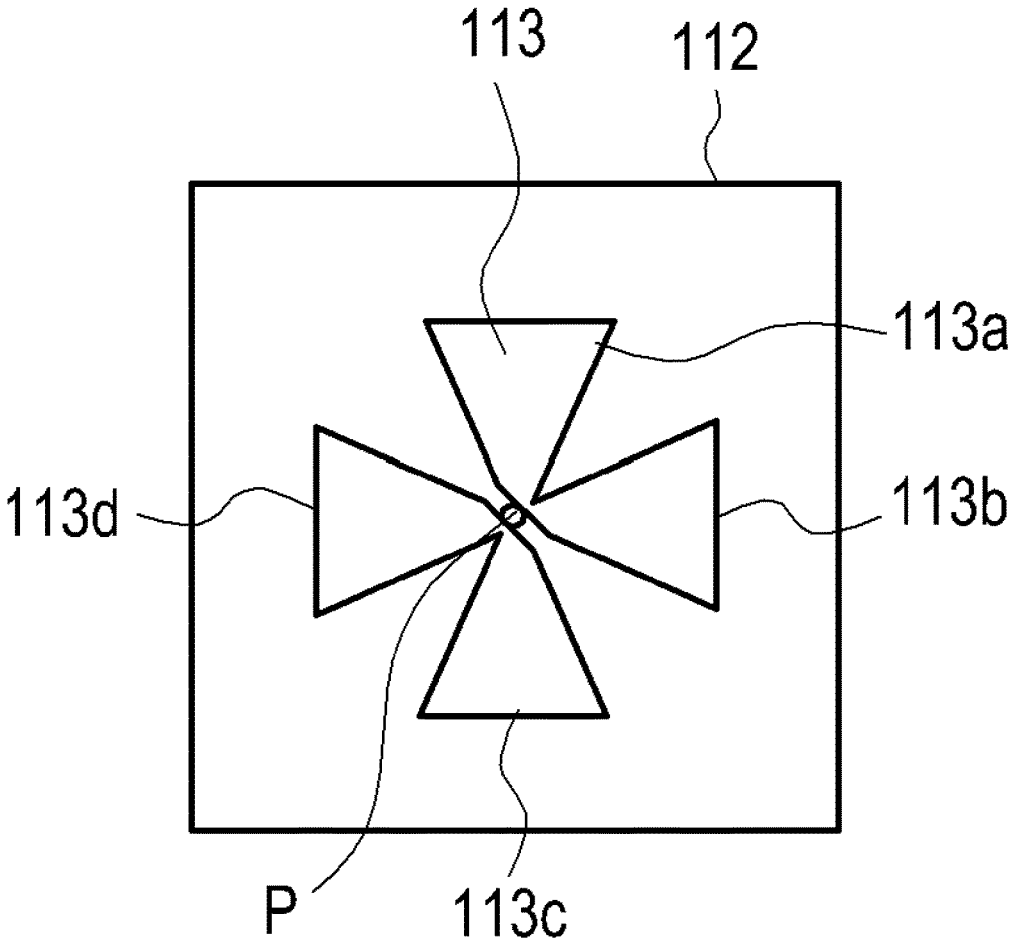
FIG. 3 is a view illustrating a second type structure of a radiation element of FIG. 1.

As illustrated in FIG. 2, it can be seen that the first to third radiation elements 11 have a (first type) structure in which a horizontal polarization dipole antenna in the shape of a miniaturized bow tie and a vertical polarization dipole antenna in the shape of the bow tie are combined to each other to generate polarization in the, for example, +45 degree direction. At this time, the horizontal polarization dipole radiation unit and the vertical polarization dipole radiation unit are designed to be symmetrical to each other, so that a correct +45 degree (or −45 degree) polarization can be generated. Meanwhile, FIG. 3 illustrates a second type structure of each radiation element 11 illustrated in FIG. 1. As in the structure illustrated in FIG. 2, the radiation pattern 113 of each radiation element 11 according to the second type structure illustrated in FIG. 3 has a combination structure of a horizontal polarization (H-pol) dipole radiation unit having two radiation arms 113*b* and 113*d* and a vertical polarization (V-pol) dipole radiation unit having two radiation arms 113*a* and 113*c*.

At this time, in each of the radiation elements, the one radiation arm 113*d* of the horizontal polarization dipole radiation unit and the other radiation arm 113*c* of the vertical polarization dipole radiation unit are connected to a feeding point P positioned at the center of the radiation element 113, and the other radiation arm 113*b* of the horizontal polarization dipole radiation unit and the other radiation arm 113*c* of the vertical polarization dipole radiation unit are connected to each other at a portion corresponding to the feeding point P. That is, the one radiation arm 113*d* of the horizontal polarization dipole radiation unit and the other radiation arm 113*c* of the vertical polarization dipole radiation unit are integrally provided as a pair, and the other radiation arm 113*b* of the horizontal polarization dipole radiation unit and the other radiation arm 113*c* of the vertical polarization dipole radiation unit are integrally provided as a pair.

At this time, the feeding unit is designed such that a connection part where the one radiation arm 113*d* of the horizontal polarization dipole radiation unit and the other radiation arm 113*c* of the vertical polarization dipole radiation unit are connected to each other and a connection part where the other radiation arm 113*b* of the horizontal polarization dipole radiation unit and the one radiation arm 113*a* of the vertical polarization dipole radiation unit are connected to each other are simultaneously fed with power through the feeding point P.

It can be seen that this structure is a structure that generates polarization in the −45 degree direction. Desired +45 degree or −45 degree polarization can be selectively generated by forming the radiation patterns of the first to fourth radiation elements of the structure illustrated in FIG. 2 or FIG. 3, as described above.

The omnidirectional antenna according to the embodiment of the present invention is formed by combining the first to third radiation elements 11, which have the same configuration as shown in FIG. 2 or FIG. 3, to each other. The first to third radiation elements may be arranged at regular intervals according to a predetermined angle from a reference point on a horizontal surface. For example, as illustrated in FIG. 1, the first to third radiation elements 11 may be installed to have a back to back posture at the same angle of 120 degrees on the entire 360 degree horizontal plane, and may be configured to radiate a beam in a horizontal direction from the installed position. At this time, each of the feeding points P of the first to third radiation elements 11 may be configured to receive signals distributed in one-third from one feeding line 14. In addition, as in a conventional antenna structure, the omnidirectional antenna according to the first embodiment of the present invention may be provided with a case (not illustrated) including a radome structure or the like that forms the overall appearance of the omnidirectional antenna, a support (not illustrated) configured to support each of the radiation elements and the feeding line, and the like. Furthermore, the omnidirectional antenna may further include signal processing devices for processing transmission/reception signals.

As illustrated in FIGS. 2 and 3, it can be seen that four radiation arms are designed to be symmetrical with each other and to have the same shape. In the case where the four radiation arms are designed to be symmetrical with each other and to have the same shape, there is an advantage in that a simulation operation for adjusting the amplitude and phase of the dipole radiation units, which shall be necessarily performed when the radiation arms are asymmetric, can be omitted. Therefore, a manufacturing process can be simplified, a production time can be shortened, and a mass production can be easily performed.

Figure 4:
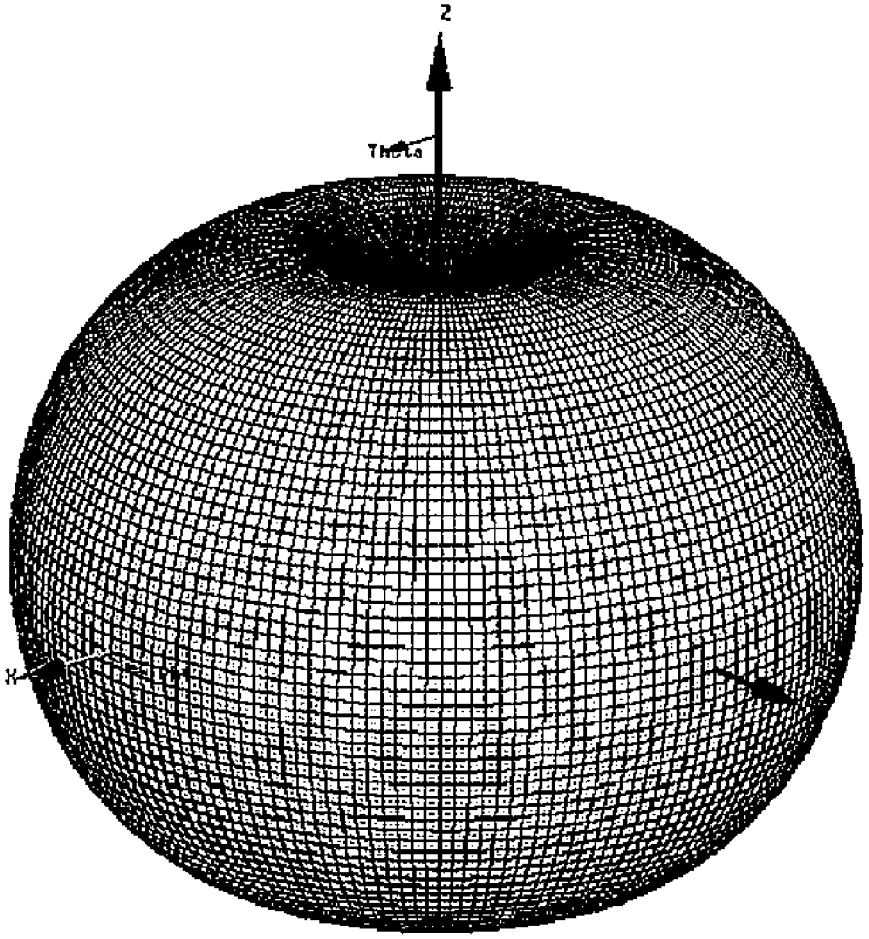
FIG. 4 is a graph representing the radiation characteristics of the omnidirectional antenna of FIG. 1.

FIG. 4 is a graph representing the radiation characteristics of the omnidirectional antenna of FIG. 1 three-dimensionally. As illustrated in FIG. 4, the omnidirectional antenna according to the first embodiment of the present invention, which is configured as illustrated in FIGS. 1 to 3, satisfies very excellent omnidirectional radiation characteristics.

Meanwhile, in the above-described configuration of the omnidirectional antenna according to the first embodiment of the present invention, when the first to third radiation elements 11 are constituted with the first type structure illustrated in FIG. 2, the omnidirectional antenna generally generates +45 degree polarization, and when the first to third radiation elements 11 are constituted with the second type structure illustrated in FIG. 3, the omnidirectional antenna generally generates −45 degree polarization. Accordingly, another embodiment of the present invention proposes a structure for generating a +/−45 degree dual polarization using both the first type radiation element and the second type radiation element. This structure can be configured by arranging, for example, a plurality of omnidirectional antenna structures as illustrated in FIG. 1 configured with the first type radiation elements, and a plurality of omnidirectional antenna structures configured with the second type radiation elements in the vertical direction.

Figure 5:
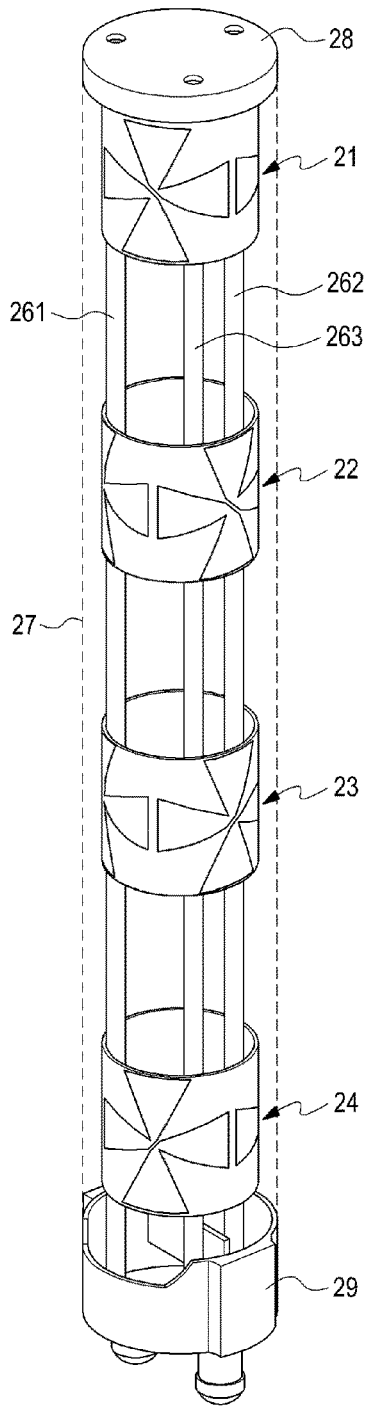
FIG. 5 is a perspective view of an omnidirectional antenna for a mobile communication service according to a second embodiment of the present invention.
Figure 6:
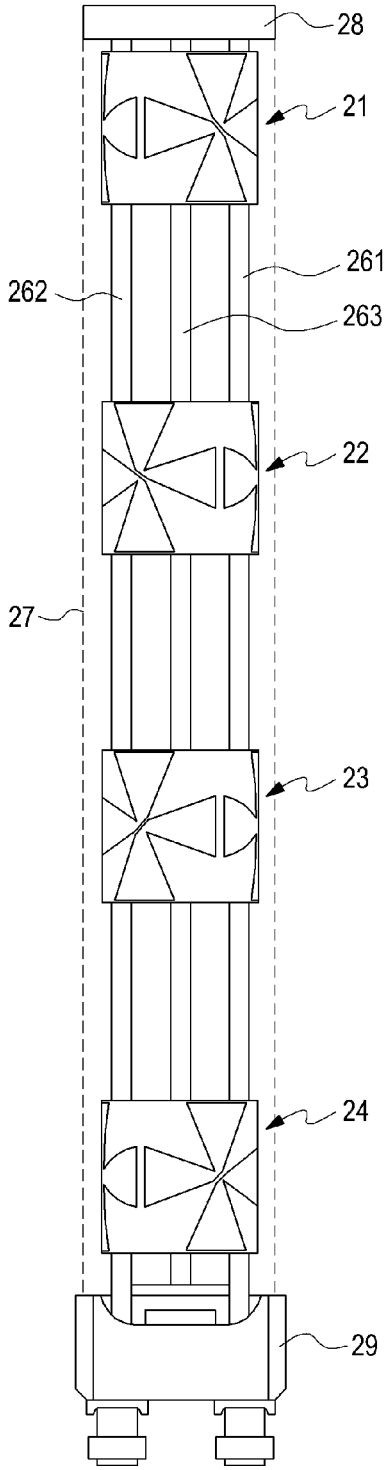
FIG. 6 is a front view of the omnidirectional antenna of FIG. 5.
Figure 7:
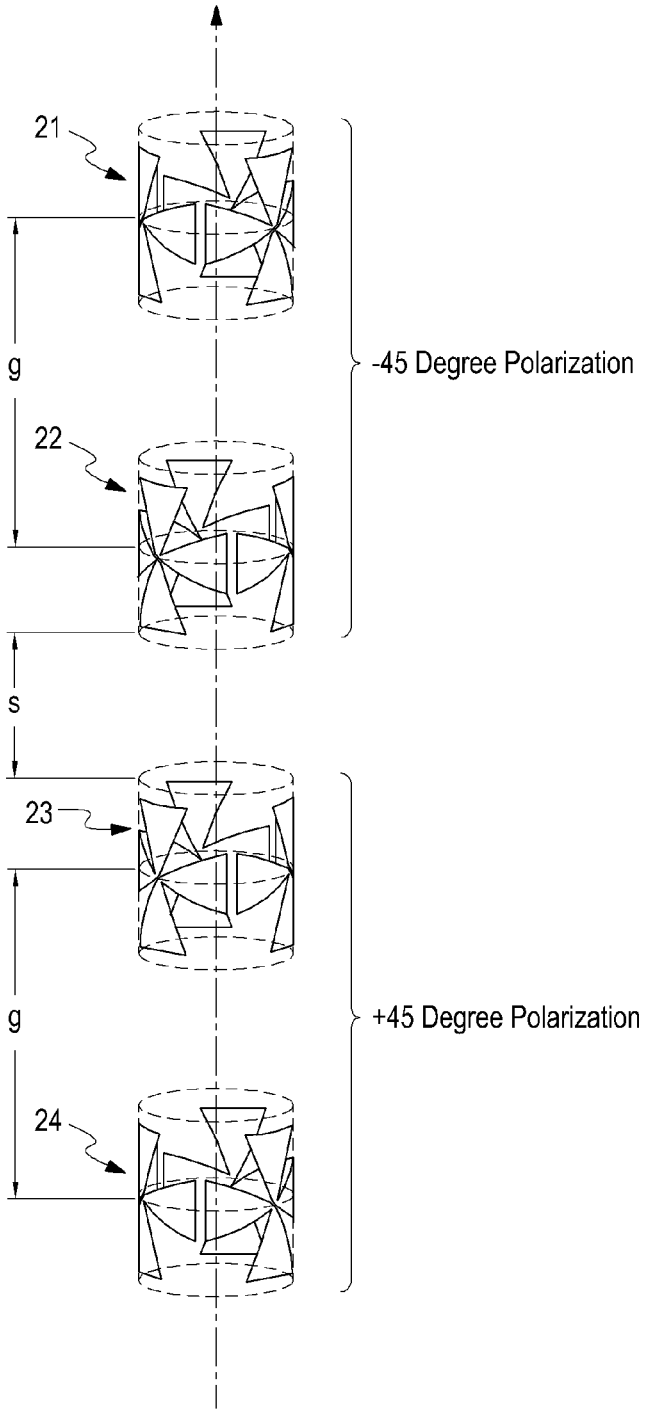
FIG. 7 is a schematic diagram illustrating a combination characteristic of polarization directions between radiation element arrays of FIG. 5.

FIG. 5 is a perspective view of an omnidirectional antenna for a mobile communication service according to a second embodiment of the present invention, FIG. 6 is a front view of the omnidirectional antenna of FIG. 5, and FIG. 7 is a schematic diagram illustrating a combination characteristic of polarization directions between radiation element arrays of FIG. 5. Referring to FIGS. 5 to 7, the omnidirectional antenna according to the second embodiment of the present invention has a structure in which a plurality of omnidirectional antenna structures shown in FIG. 1 are combined with each other. Hereinafter, each of a plurality of combined omnidirectional antenna structures will be referred to as a "radiation element array."

That is, the omnidirectional antenna according to the second embodiment of the present invention may be configured by continuously arranging first to fourth radiation element arrays 21, 22, 23, and 24 in the vertical direction. At this time, the first and second radiation element arrays 21 and 22 may be constituted with the second type radiation elements illustrated in FIG. 3, and may have a configuration that omnidirectionally generates −45 degree polarization. In addition, the third and fourth radiation element arrays 23 and 24 may be constituted with the first type radiation elements illustrated in FIG. 2, and may have a configuration that omnidirectionally generates +45 degree polarization.

Accordingly, as illustrated in FIG. 7, the omnidirectional antenna according to the second embodiment of the present invention is configured such that the −45 degree polarization generated in the first and second radiation element arrays 21 and 22 and the +45 degree polarization generated in the third and fourth radiation element arrays 23 and 24 are combined with each other to generally generate a +/−45 degree dual polarization. At this time, as illustrated in FIG. 7, the omnidirectional antenna may have a structure in which radiation element arrays having the same polarization may be coupled and arranged to be adjacent to each other in order to increase an isolation between the +45 degree polarization and the −45 degree polarization.

As the spacing distance S between the radiation element arrays generating different polarizations (e.g., the second and third radiation element arrays) is increased, the isolation characteristic is improved. However, it is necessary to reduce the separation distance S for the miniaturization of the antenna and the like. There are several factors that influence the spacing distance S. As the radiation beam width of each of the radiation element arrays decreases, the interference between the radiation element arrays may be reduced and the spacing distance S may be further reduced. Also, the spacing distance S is inversely proportional to the number of radiation element arrays.

In addition, a spacing distance g between the radiation element arrays generating the same polarization (e.g., the first and second radiation element arrays, or the third and fourth radiation element arrays) may be properly set in consideration of a sidelobe characteristic, a gain, and the like. For example, the spacing distance g may be set to about 0.75 to 0.8 λ (λ: wavelength) with respect to a processing frequency. Since the spacing distance g is proportional to the magnitudes of the gain and the sidelobe, the smaller the spacing distance g is, the smaller the sidelobe can be. This makes it possible to further miniaturize the omnidirectional antenna.

Further, in order to secure a higher isolation between the radiation element arrays having the same polarization, the radiation element arrays are installed to relatively have a difference of about 60 degrees on a horizontal plane. For example, as more clearly illustrated in FIG. 6, when the radiation elements arranged in the first radiation element array 21 are installed at positions facing 0 degrees, 120 degrees, 240 degrees in a horizontal plane, the radiation elements arranged in the second radiation element array 22 may be installed at positions facing, for example, 60 degrees, 180 degrees, and 300 degrees, respectively.

The omnidirectional antenna according to the second embodiment of the present invention may be constructed as illustrated in FIGS. 5 to 7. FIGS. 5 and 6 illustrate that the omnidirectional antenna according to the second embodiment of the present invention includes an upper cap 28 and a lower cap 29 as a case that forms the entire exterior of the omnidirectional antenna, as in a conventional antenna structure, and that a radome 27 is provided to enclose the radiation element arrays between the upper cap 28 and the lower cap 29. Further, it is illustrated that the omnidirectional antenna according to the second embodiment of the present invention includes a plurality of supporting members (for example, first to third supports 261, 262, and 263) that are formed of a material that does not affect the characteristics of RF waves (e.g., plastic or Teflon) to support the radiation element arrays. In addition, the omnidirectional antenna may further include a feeding structure configured for feeding power to respective radiation element arrays and signal processing devices for processing transmission/reception signals.

Figure 8:
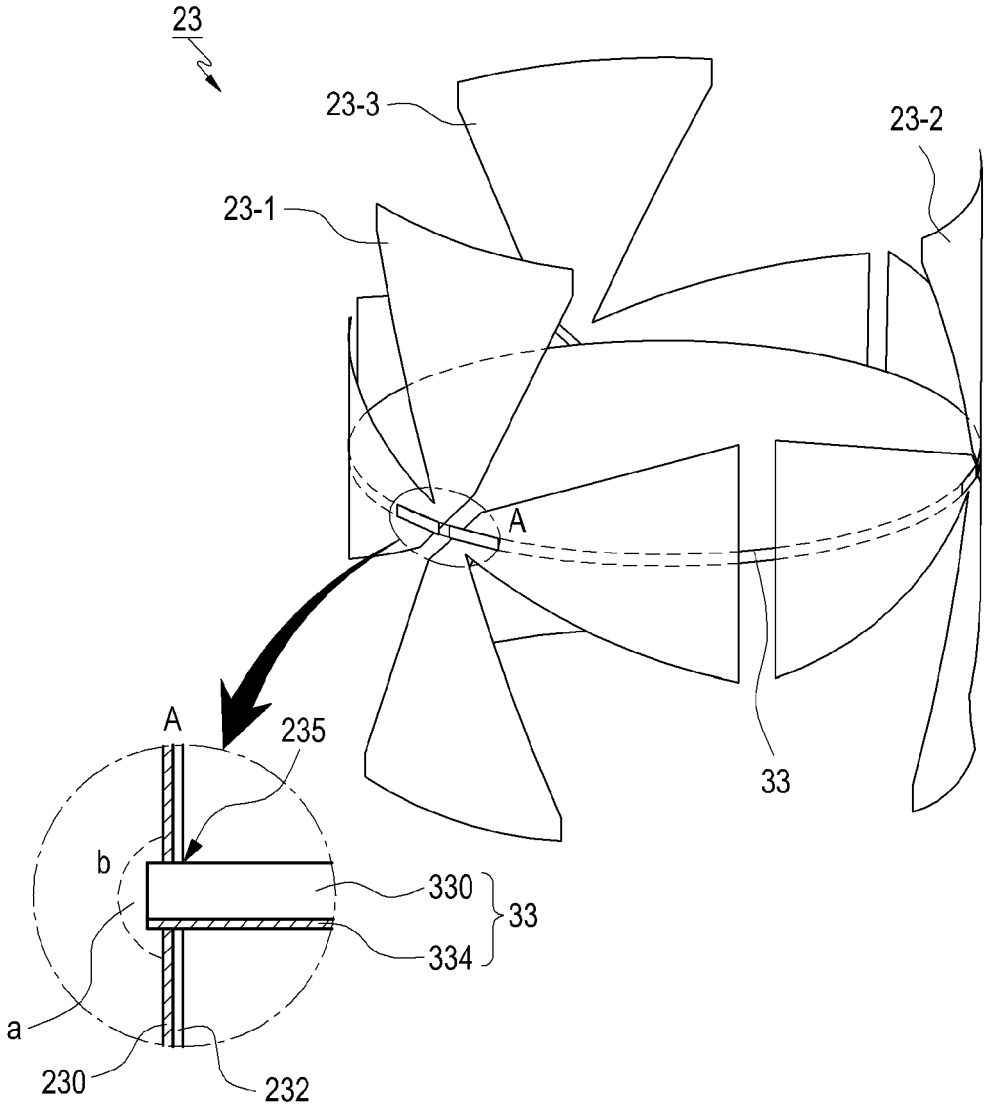
FIG. 8 is a detailed perspective view illustrating a radiation element array of FIG. 5.
Figure 9:
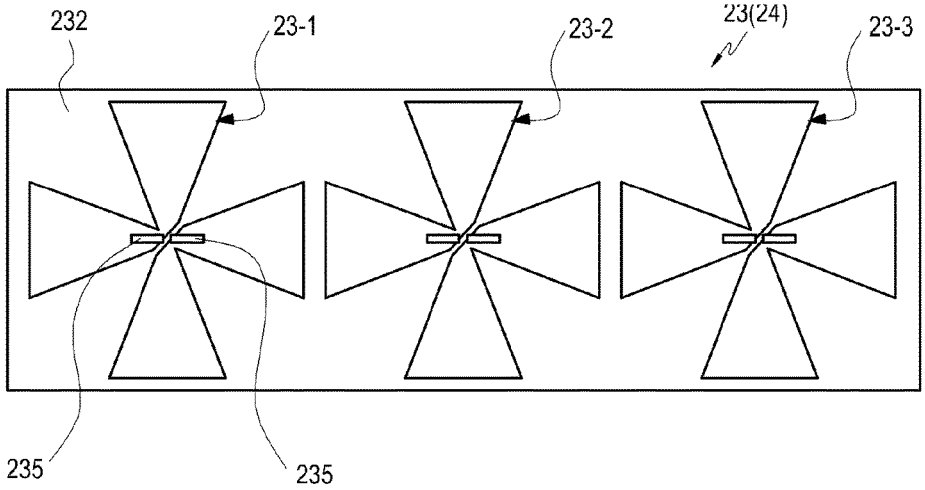
FIG. 9 is a plan view of a radiation element array of FIG. 5 in a deployed state.
Figure 10:
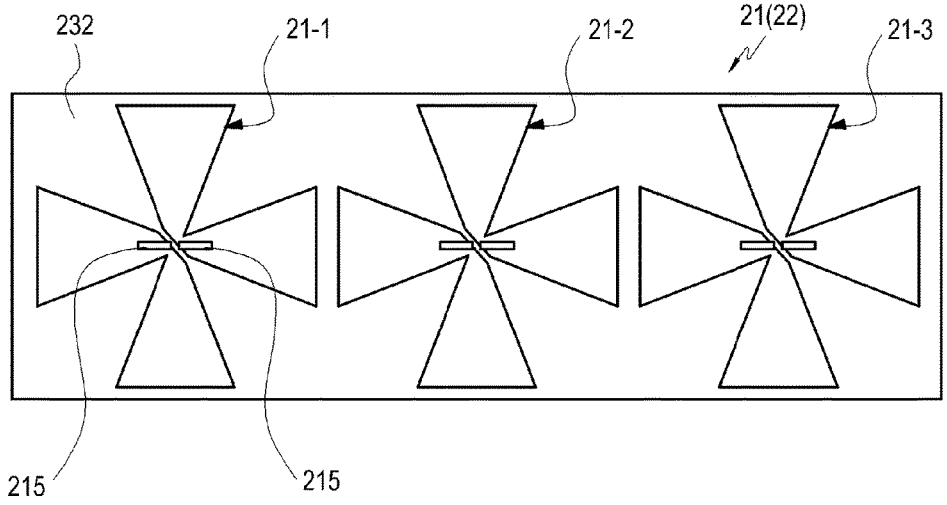
FIG. 10 is a plan view of another radiation element array of FIG. 5 in a deployed state.

FIG. 8 is a detailed perspective view of a radiation element array of FIG. 5 (e.g., a third radiation element array 23), FIG. 9 is a plan view illustrating the radiation element array of FIG. 5 (e.g., the third radiation element array 23) in a deployed state, and FIG. 10 is a plan view illustrating another radiation element array of FIG. 5 (e.g., a first radiation element array 21) in a deployed state. Referring to FIGS. 8 to 10, each of the first to fourth radiation element arrays 21 to 24 illustrated in FIG. 5 may have a configuration in which a plurality of (e.g., three) radiation elements 23-1, 23-2, and 23-3, or 21-1, 21-2, and 21-3 are printed on a single flexible printed circuit board 232 or 212 in a pattern printing manner to be formed (e.g., to be successively arranged) at a predetermined interval. (In FIG. 8, the illustration of the configuration corresponding to a printed circuit board is omitted for the convenience of description.)

As described above, the flexible printed circuit board 232 or 212, on which the three radiation elements 23-1, 23-2, and 23-3, or 21-1, 21-2, and 21-3 are successively formed, is installed in a form in which the flexible printed circuit board 232 or 212 is subsequently rolled in a cylindrical shape, and both sides to be in contact with each other are bonded and fixed to each other. As described later, the radiation elements installed on the flexible printed circuit board 232 or 212 may have a structure in which power is fed through a feeding board 33 (e.g., see FIG. 8) of a printed circuit board structure on which a feeding pattern is formed. At this time, the feeding board may be formed in a circular shape having a size corresponding to the flexible printed circuit board 232 or 212, and the flexible printed circuit board 232 or 212 may be installed in the form of being rolled in a round shape enclosing the circular feeding board.

At this time, in each flexible printed circuit board 232 or 212, for each radiation element 23-1, 23-2, and 23-3, or 21-1, 21-2, and 21-3, each of two radiation arms of the horizontal polarization radiation unit may have a through hole 235 or 215 formed in the vicinity of the feeding point. In addition, the feeding board 33 (see, e.g., FIG. 8) may have a protrusion a that is formed to have a size corresponding to that of the through hole 235 or 215 at a position corresponding to a position where the through hole 235 or 215 is formed. When the flexible printed circuit board 232 or 212 is installed through the above-described structure in such a manner that the flexible printed circuit board 232 or 212 is installed in a state of being rolled in a round shape to enclose the feeding board, the flexible printed circuit board 232 or 212 may be installed in a state where the protrusions a of the feeding board are fitted to the through holes 235 or 215, respectively.

In FIG. 8, a state in which a protrusion a of the feeding board 33 is inserted through the through-hole 235 of the flexible printed circuit board 232 is illustrated in more detail in a circular region A indicated by a one-dot chain line. At this time, the feeding board 33 is formed with a ground pattern 334 (extending to the protrusion a) on the lower surface of the substrate inner layer 330 made of epoxy or the like. Subsequently, a soldering operation is performed as indicated by the region b in the state where the protrusion a is inserted into the through hole 235 of the flexible printed circuit board 232. Through this, the flexible printed circuit board 232 and the feeding board 33 can be more stably fixed. Further, the horizontal polarization dipole radiation pattern 230 of each of the radiation elements 23-1, 23-2, and 23-3 formed in the portions of the respective through holes 235 of the flexible printed circuit board 232 can be electrically connected to the ground pattern 334 of the feeding board 33.

As can be clearly understood from the configuration illustrated in FIGS. 8 to 10, in an omnidirectional antenna according to some embodiments of the present invention, each of the radiation elements 23-1, 23-2, 23-3, or 21-1, 21-2, and 21-3 are formed in each flexible printed circuit board 232 or 212, and then the flexible printed circuit board 232 or 212 is installed in the state of being rolled in a round shape. Thus, it can be seen that the radiation elements 23-1, 23-2, and 23-3, or 21-1, 21-2, and 21-3 have a convex surface in the middle portion compared to the left and right edges, rather than being completely flat as a whole. This configuration enables a design that is capable of minimizing the overall horizontal size of the radiation element arrays and thus the omnidirectional antenna. Furthermore, the combination of radiation beams radiated from the respective radiation elements 23-1, 23-2, 23-3, or 21-1, 21-2, and 21-3 can be optimized to have optimal omnidirectional radiation characteristics.

Figure 11:
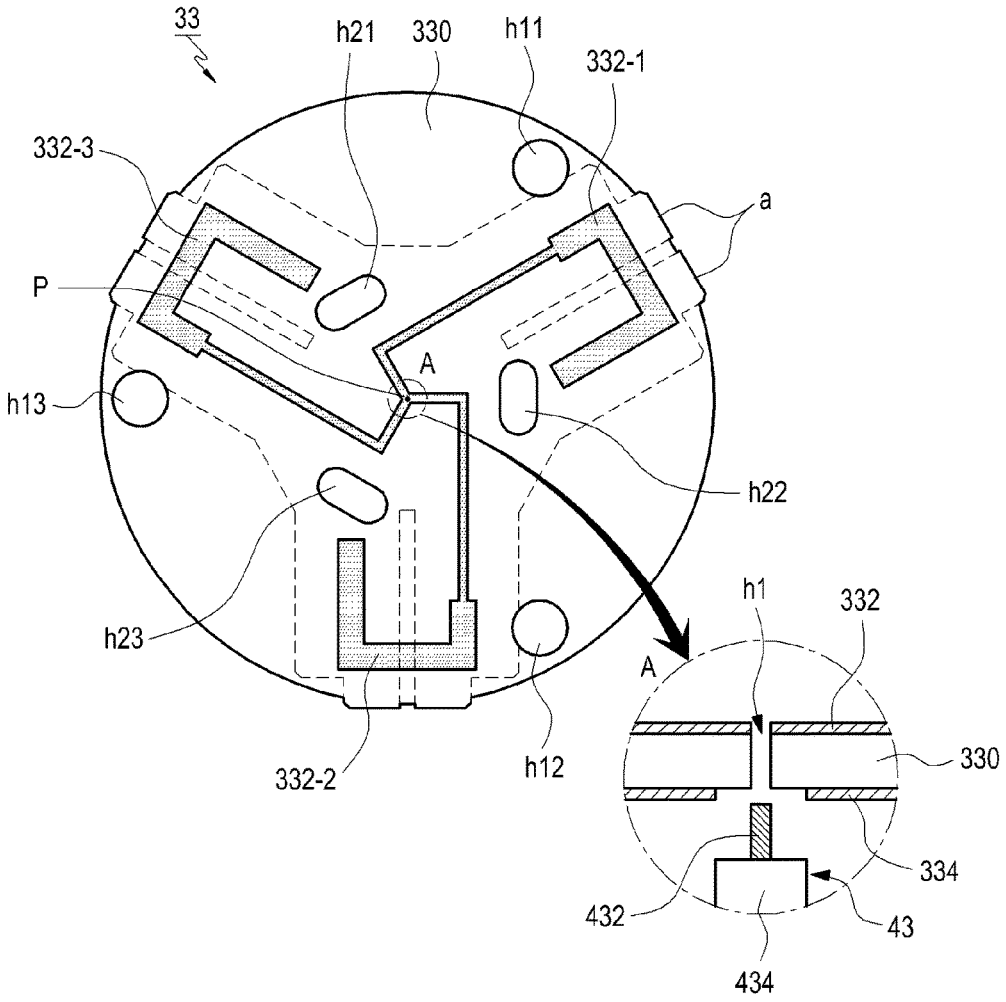
FIG. 11 is a plan view of a feeding board applied to a radiation element array of FIG. 5.
Figure 12:
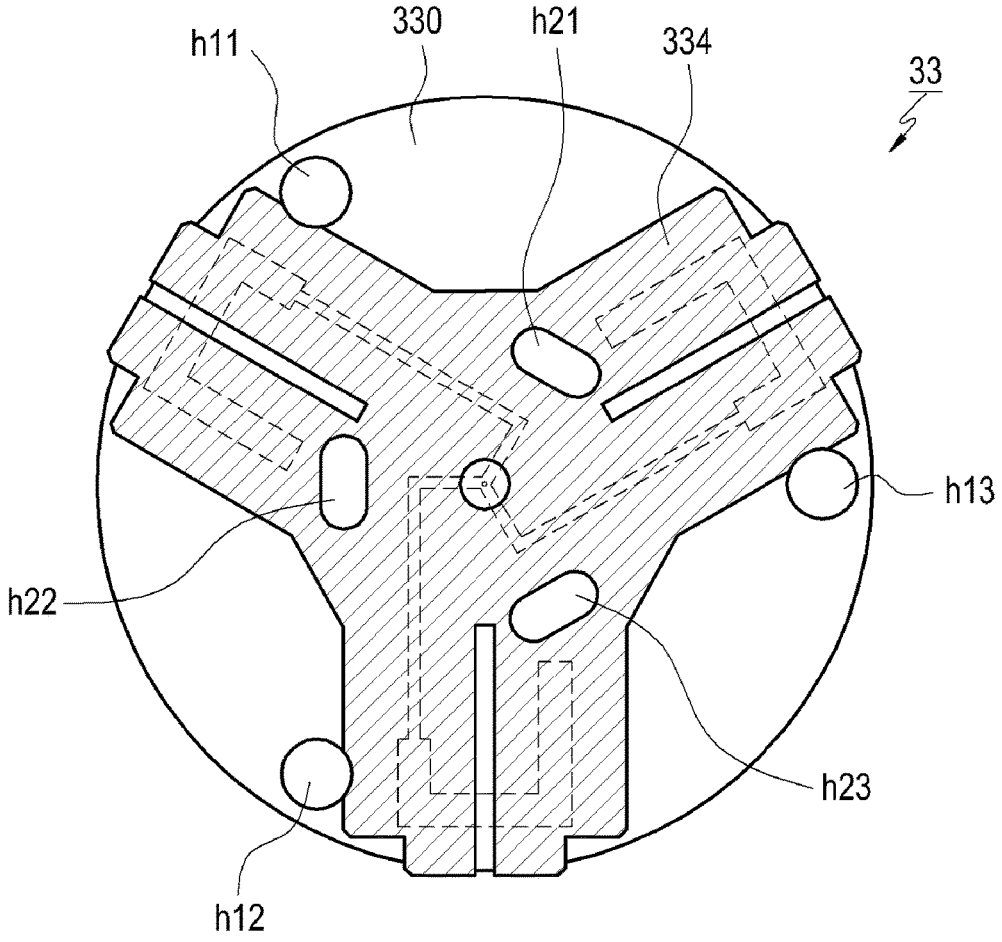
FIG. 12 is a rear view of the feeding board of FIG. 11.
Figure 13:
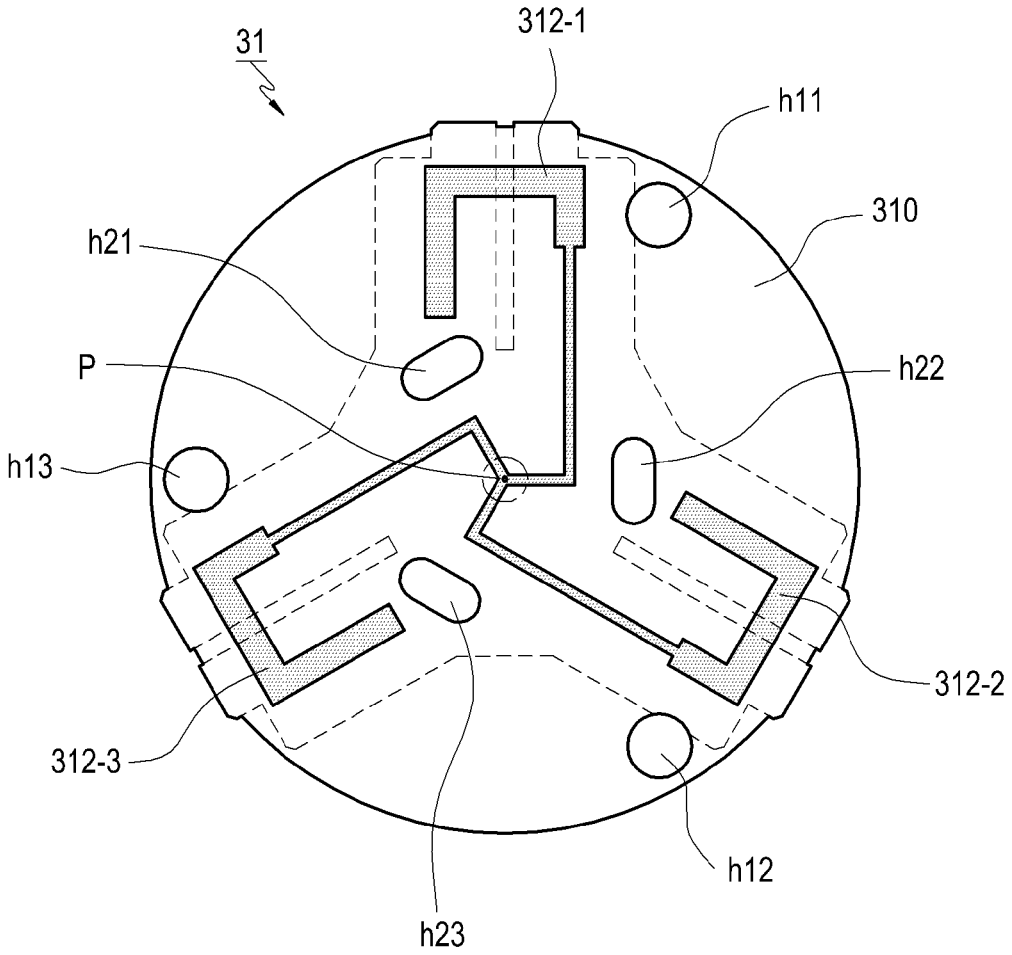
FIG. 13 is a plan view of a feeding board applied to another radiation element array of FIG. 5.
Figure 14:
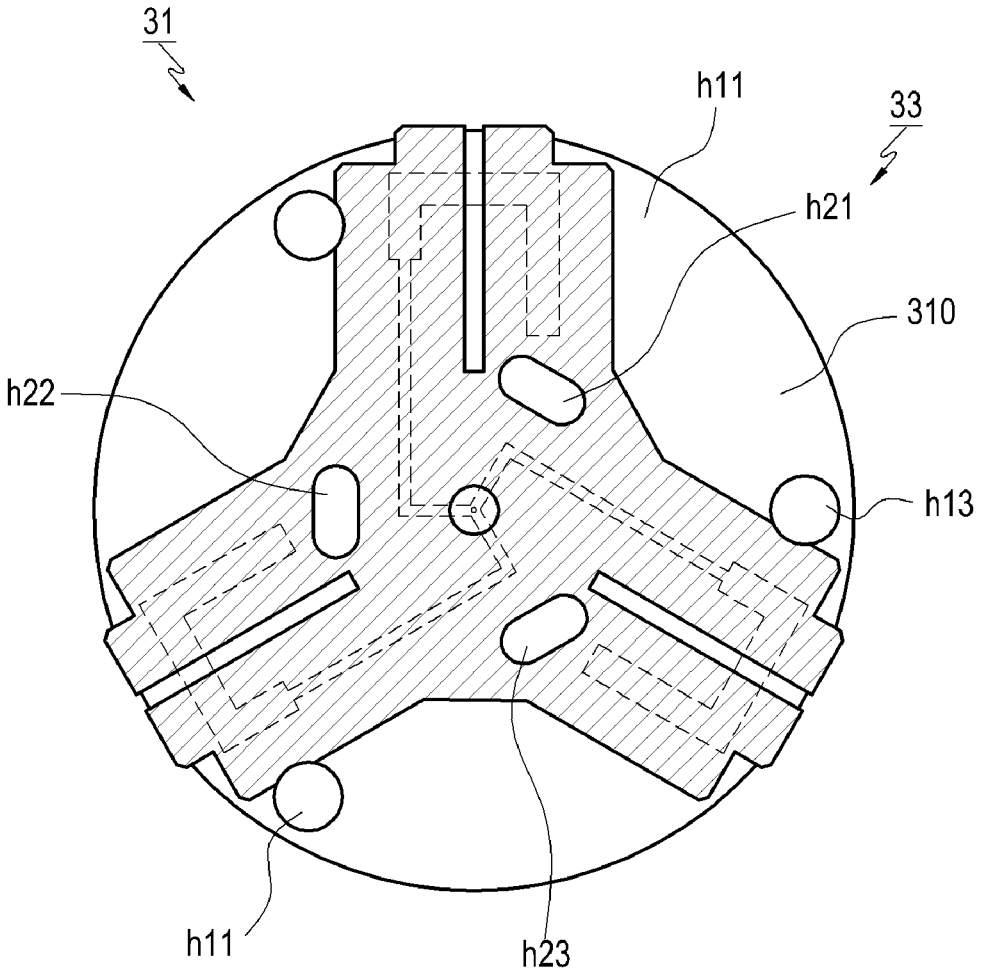
FIG. 14 is a rear view of the feeding board of FIG. 13.

FIGS. 11 and 12 are a plan view and a rear view, respectively, of a first type feeding board 33 applied to a radiation element array of FIG. 5 (e.g., a third radiation element array 23). FIGS. 13 and 14 are a plan view and a rear view, respectively, of a second type feeding board 31 applied to another radiation element array of FIG. 5 (e.g., a first radiation element array 21). Referring to FIGS. 11 to 14, the configuration of a feeding board 33 or 31 as a configuration of a feeding unit that feeds a feeding signal to each of the radiation element arrays will be described. First, the first type feeding board 33 includes an inner layer 330 formed of an epoxy material or the like, feeding patterns 332 (232-1, 232-2, and 232-3) formed on the top surface of the inner layer 330; and a ground pattern 334 formed on the bottom surface of the inner layer 330. In addition, a plurality of supports (e.g., the supports 261, 262, and 263 in FIGS. 5 and 6) penetrate the first type feeding substrate 33, in which a plurality of through holes h11, h12 and h13 are formed to be configured by the plurality of supports. Further, as will be described below, a plurality of connection passages h21, h22, and h23 through which the feeding lines pass, respectively, may be formed in the form of through holes at appropriate positions.

The feeding patterns 332 (332-1, 332-2, and 332-3) include first to third coupling feeding patterns 332-2, 332-1, and 332-3 configured to feed power to three radiation elements formed on a corresponding radiation element array 23. The first to third coupling feeding patterns 332-2, 332-1, and 332-3 include a pattern for feeding power, in a coupling manner, to the respective radiation elements of the corresponding radiation element array 23 in the protrusion a where the feeding board 33 and the radiation element array 23 are coupled to each other. Each of the first to third coupling feeding patterns 332-2, 332-1, and 332-3 is patterned in a structure to receive feeding signals distributed from one feeding point P formed at the center of the feeding substrate 33. The feeding point P is configured to receive a feeding signal through a feeding line (e.g., the feeding line 43) that may be configured with a coaxial cable.

A connection structure of the feeding board 33 and the feeding line 43 is illustrated in more detail in a circular region A indicated by a one-dot chain line in FIG. 11, and may be connected to the feeding line 43 at the bottom side of the feeding substrate 33. An inner conductor 432 of the feeding line 43 configured with the coaxial cable is inserted through the through hole h1 formed at the feeding point P, and penetrates the feeding board 33 to be connected to the feeding pattern 332 of the top surface of the feeding board 33. At this time, an outer conductor 434 of the feeding line 43 is connected to the ground pattern 334 on the bottom surface of the feeding board 33. The feeding pattern 332 and the inner conductor 332 of the feeding line 43 are soldered to each other on the top surface of the feeding substrate 33, and the ground pattern 334 and the outer conductor 434 of the feeding line 43 are soldered to each other on the bottom surface of the feeding board 33.

FIGS. 13 and 14 illustrate a second type feeding board 31. Like the first type feeding board 33, the second type feeding board 31 includes an inner layer 310, feeding patterns 312 (312-1, 312-2, and 312-3) formed on the top surface of the inner layer 310, and a ground pattern 314 formed on the bottom surface of the inner layer 310. In addition, a plurality of through holes (h11, h12, h13) through which the plurality of supports pass to be supported by the plurality of supports, and a plurality of connection passages h21, h22, and h23 through which the plurality of feeding lines passes, respectively, are formed at proper positions.

The feeding patterns 312 (312-1, 312-2, and 312-3) include first to third coupling feeding patterns 312-2, 312-1, and 312-3 configured to feed power to three radiation elements formed on a corresponding radiation element array 21. Each of the first to third coupling feeding patterns 312-2, 312-1, and 312-3 is patterned in a structure to receive feeding signals distributed from one feeding point P formed at the center of the feeding substrate 31. The feeding point P is configured to receive a feeding signal through a feeding line that may be configured with a coaxial cable.

At this time, the first to third coupling feeding patterns 312-1, 312-2, and 312-3 formed on the second type feeding board 31 are somewhat different from those formed on the feeding board 33 illustrated in FIGS. 11 and 12. That is, the first to third coupling feeding patterns 312-2, 312-1, and 312-3 formed on the second type feeding board 31 are formed such that a feeding signal advancing direction in a signal coupling portion is opposite to that in the patterns formed on the feeding board 33 illustrated in FIGS. 11 and 12.

Figure 15:
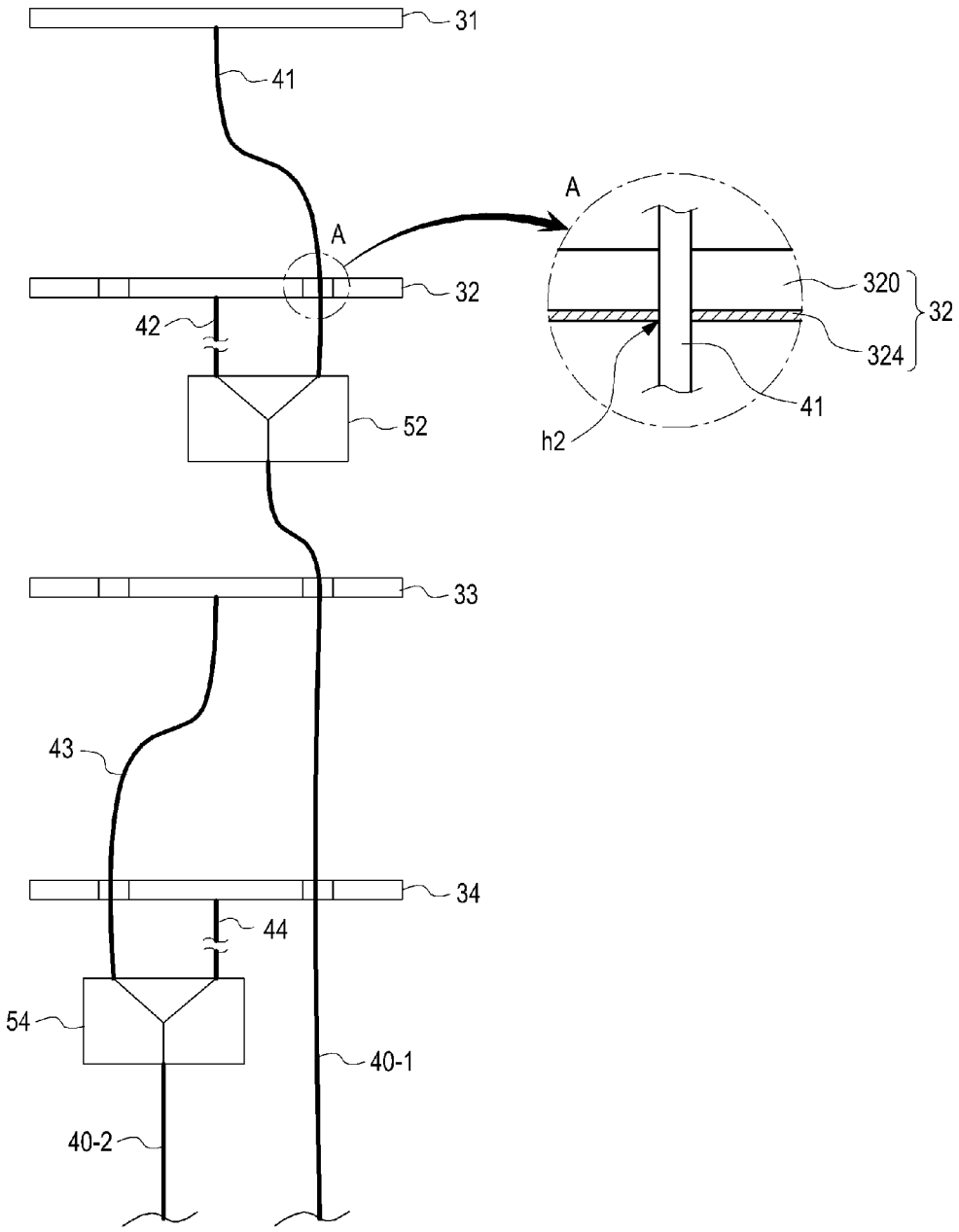
FIG. 15 is a view illustrating a connection structure of a feeding line for feeding boards of the omnidirectional antenna of FIG. 5.

FIG. 15 is a view illustrating a connection structure of a power feeding line for power feeding boards of the omnidirectional antenna of FIG. 5. FIG. 15 schematically illustrates a state in which first to fourth feeding boards 31, 32, 33, and 34 respectively corresponding to the four radiation element arrays are successively installed from the upper side. Referring to FIG. 15, the first to fourth feeding boards 31, 32, 33, and 34 are respectively fed with power via the first to fourth feeding lines 41, 42, 43, and 44. At this time, the first and second feeding lines 41 and 42 are configured to receive signals, which are distributed through the first distributor 52, from a first common feeder line 40-1. Similarly, the third and fourth feeding lines 43 and 44 are configured to receive signals, which are distributed through the second distributor 54, from a second common feeder line 40-2.

In this configuration, the feeding lines (the feeding lines 41, 43, and 40-1 in the example of FIG. 15) passing through different feeding board portions among the respectively feeding lines 41-44 are designed to pass through the connection passages h2 (e.g., the connection passages h21, h22, and h23 in FIGS. 11 to 14) formed in the respective feeding boards 31 to 34. In FIG. 15, a structure in which the first feeding line 41 passes through the connection passage h2 of the second feeding substrate 32 is illustrated in more detail in a circular region A indicated by a one-dot chain line. At this time, the first feeding line 41 (the outer conductor), which may be configured with a coaxial cable, is soldered to the ground pattern 324 formed on the bottom surface of the second feeding board 32. Similarly, the feeding lines passing through the connection passages of the respective feeder substrates are soldered to the ground pattern formed on the bottom surface of the feeding board. Thus, a cable ground of a coaxial cable corresponding to each of the feeding lines and the ground of each feeding board are soldered to each other, so that the grounding characteristic can be stabilized.

On the other hand, in the above configuration, for example, the lengths of feeding lines connected to the respective feeding boards are designed to be the same in order to match the phases of the beams emitted from the respective radiation element arrays. Accordingly, for example, the lengths of the first feeder line 41 and the second feeder line 42 connected to the first distributor 52 may be designed to be the same. In this case, since the first feeding board 31 and the second feeding board 32 are of the same type to have the same phase, there is no phase difference between the two boards. If the first type feeding board and the second type feeding board have structures in which the feeding signals have a phase difference of 180 degrees therebetween according to the difference of the feeding patterns thereof, it is possible to considerably reduce the length of the feeding line connected to any one of the feeding boards to correspond to the phase difference of 180 degrees by properly differently designing the types of the feeding boards to be installed to the respective radiation element arrays. At this time, the reduced length of the feeding line may vary depending on a wavelength, a dielectric constant, and the like. For example, when the length of the first feeder line 41 is 100 mm, it is possible to reduce the length of the second feeding line 42 to 60 mm at 2 GHz, 40 mm at 2.6 GHz, and the like.

The construction of such a feeding line is capable of simplifying the complicated connection points of a plurality of feeding cables in the related art. Therefore, it is possible to improve the structural convenience in designing the antenna, to reduce the power loss according to the cable, and to meet the purpose of reducing the size and weight of the antenna.

Figure 16:
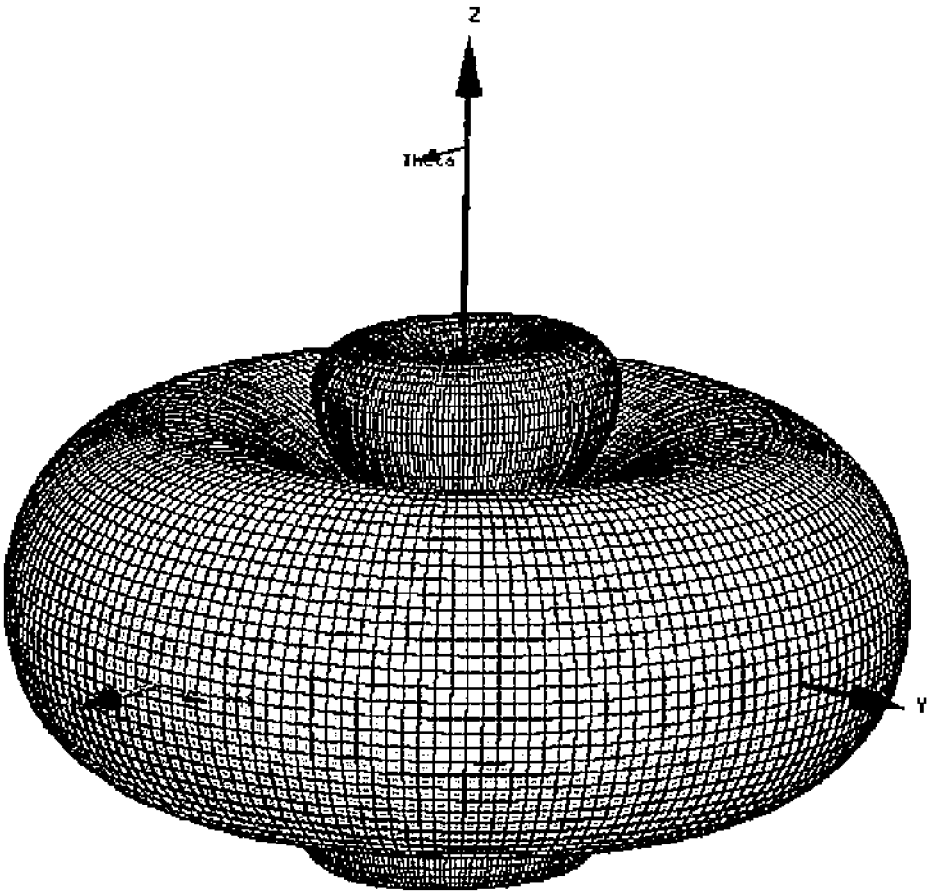
FIGS. 16 to 19 are graphs representing the radiation characteristics of the omnidirectional antenna of FIG. 5.
Figure 17:
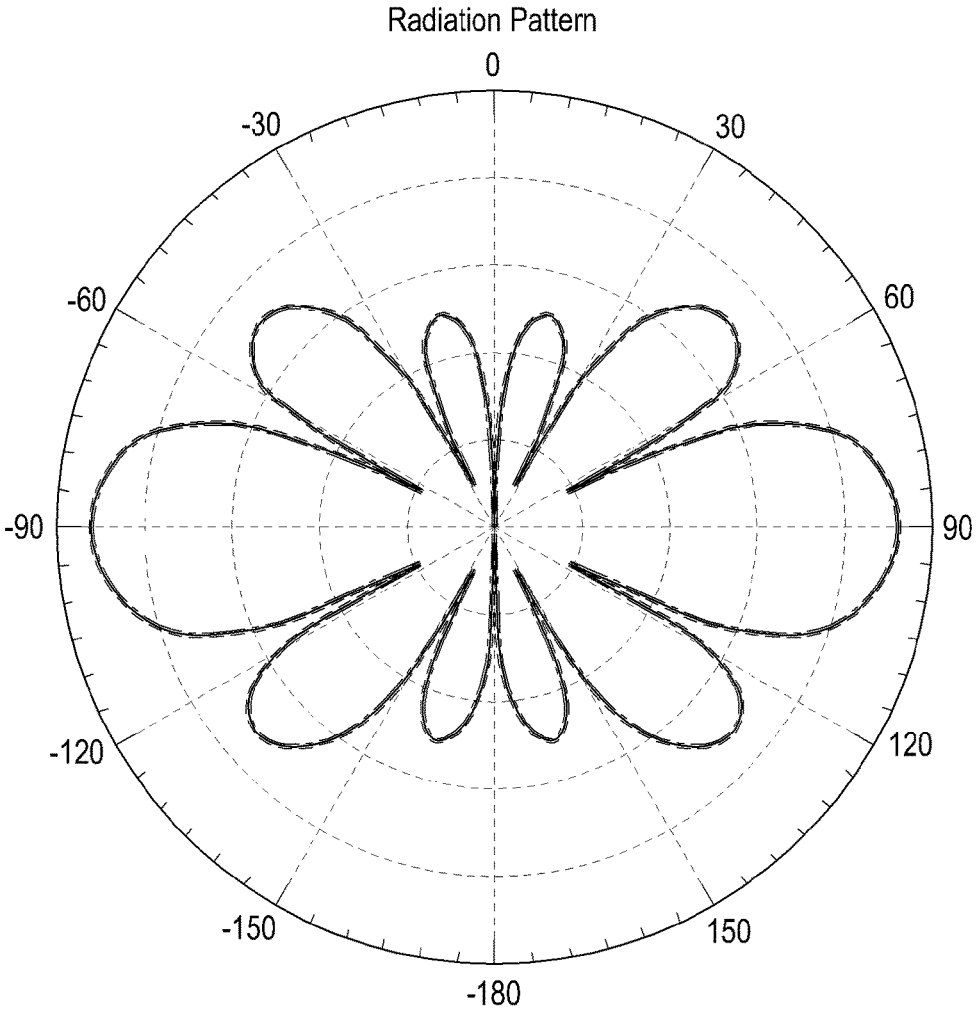
Figure 18:
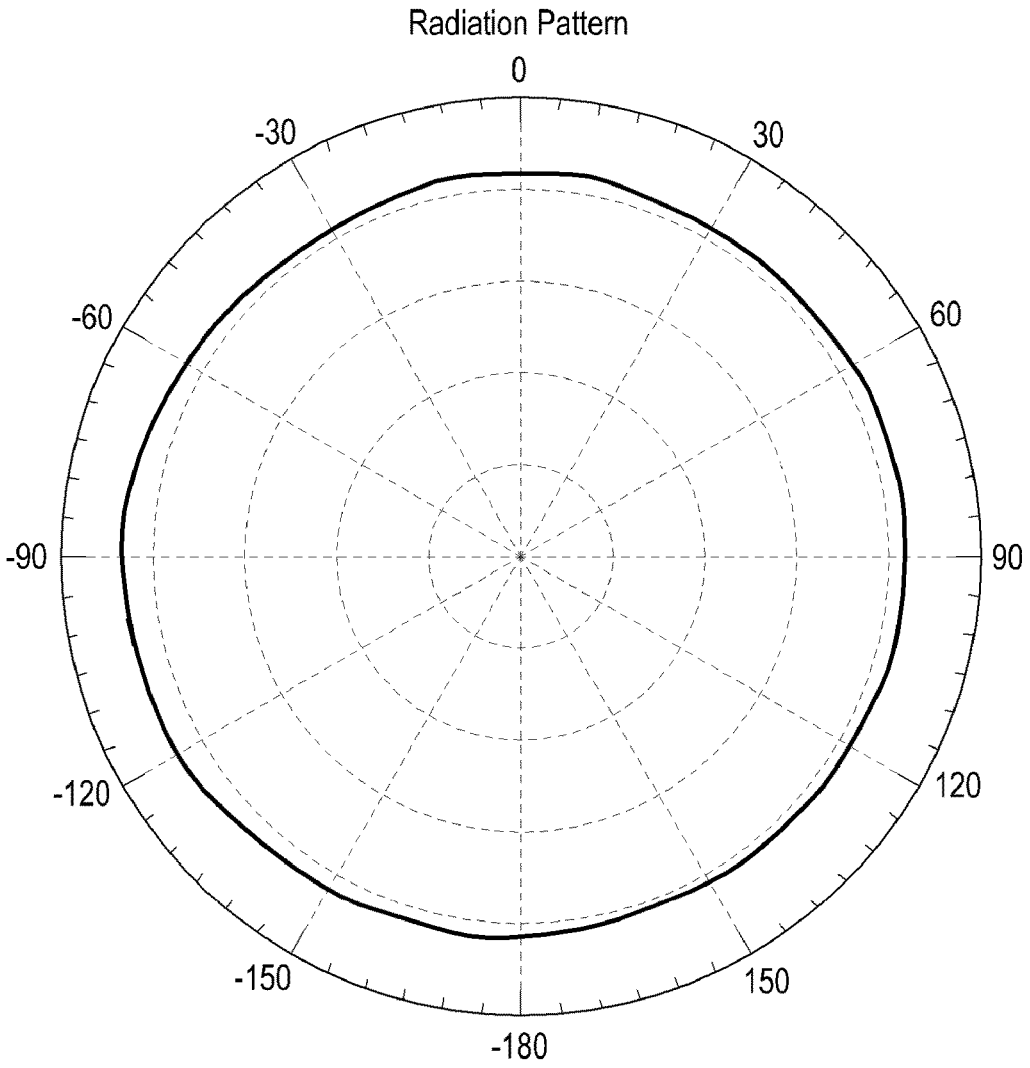
Figure 19:
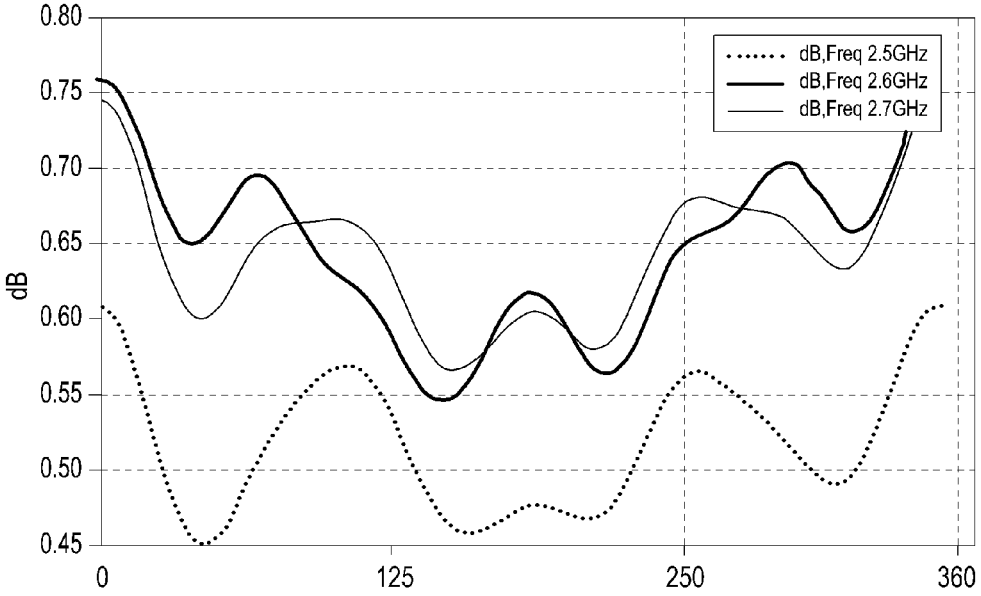

FIGS. 16 to 19 are graphs representing radiation characteristics of the omnidirectional antenna of FIG. 5, in which FIG. 16 three dimensionally illustrates the radiation characteristics of the omnidirectional antenna, FIG. 17 illustrates vertical radiation characteristics, and FIGS. 18 and 19 illustrate horizontal radiation characteristics. As illustrated in FIGS. 15 to 19, it can be seen that the omnidirectional antenna according to the embodiment of the present invention has very excellent omnidirectional radiation characteristics. Particularly, as illustrated in FIGS. 18 and 19, it can be seen that a horizontal ripple characteristic in the omnidirectional radiation pattern is about 0.2 dB at the design frequency bands (for example, 2.5 GHz, 2.6 GHz, and 2.7 GHz), and a very excellent radiation pattern is exhibited.

The configurations and operations of omnidirectional antennas for a mobile communication service according the embodiments of the present invention may be implemented as described above. While specific embodiments have been described above, various modifications can be made without departing from the scope of the present invention.

For example, in the foregoing descriptions of the embodiments, it has been disclosed that the omnidirectional antennas or the radiation element arrays are formed by three radiation elements, which is a configuration for minimizing the size of the radiation element arrays and the omnidirectional antenna. If the size constraint is not large at the time of designing the radiation element arrays and the omnidirectional antenna, it is also possible to form one radiation element array or omnidirectional antenna by combining four or more radiation elements. In addition, in some cases, it is also possible to combine only two radiation elements. A design may be made while changing the number of radiation elements according to the use environment of the antenna. For example, in order to reduce the influence of the ripple that increases in proportion to a diameter of the antenna in the high frequency band, it is possible to reduce the number of radiation elements in the high frequency band and to increase the number of radiation elements in the low frequency band.

Figure 20:
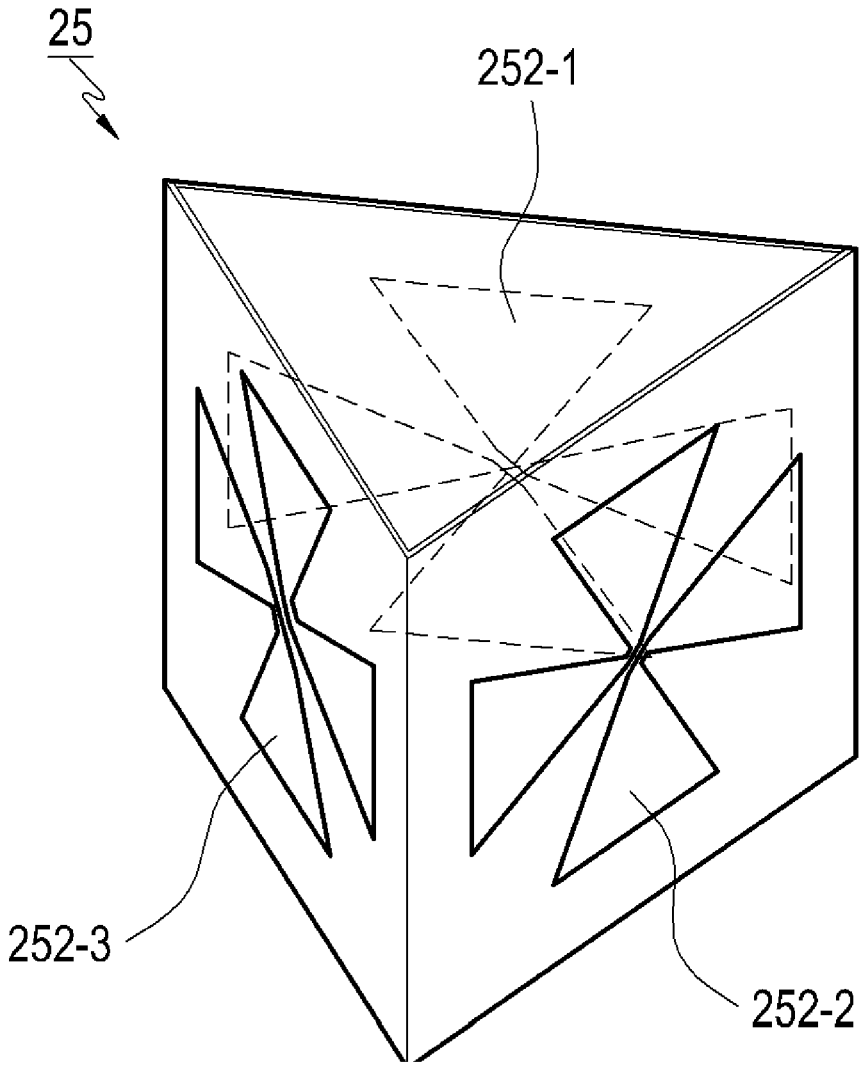
FIG. 20 is a perspective view of a radiation element array according to another embodiment of the present invention.

In the forgoing description, it has been described that the flexible printed circuit board on which the plurality of radiation elements are formed has a cylindrical shape. However, the flexible printed circuit board may have a polyhedral shape, besides the cylindrical shape. For example, the radiation element array 25 illustrated in FIG. 20 includes three radiation elements 252-1, 252-2, and 252-3 that are formed on the flexible printed circuit board At this time, the flexible printed circuit board may be configured in a form in which the flexible printed circuit board is folded, for example, in the shape of a triangular column and the radiation elements 251-1, 251-2, and 251-3 are disposed one by one on each side of the triangular column. In the foregoing description, it has been described that the radiation elements forming one omnidirectional antenna or one radiation element array are all constituted as the first type that generates +45 degree polarization or the second type that generate −45 degree polarization. However, a structure in which the first type radiation elements and the second type radiation elements are mixed may also be possible. For example, one radiation element array may be configured in a form in which the first type radiation elements generating a +45 degree polarization and the second type radiation elements generating a −45 degree polarization are alternately arranged.

In addition, it has been described that the omnidirectional antenna according to the second embodiment described above has a structure in which four radiation element arrays are combined. However, a structure in which two radiation element arrays or six or more radiation element arrays are combined may also be possible. In addition, it has been described that the omnidirectional antenna according to the second embodiment has a structure in which the radiation element arrays having the same polarization are coupled to each other to be disposed adjacent to each other. However, the omnidirectional antenna may be configured in a form in which the radiation element arrays generating a +45 degree polarization and the radiation element arrays generating a −45 degree polarization are arranged alternately in the vertical direction.

Figure 21:
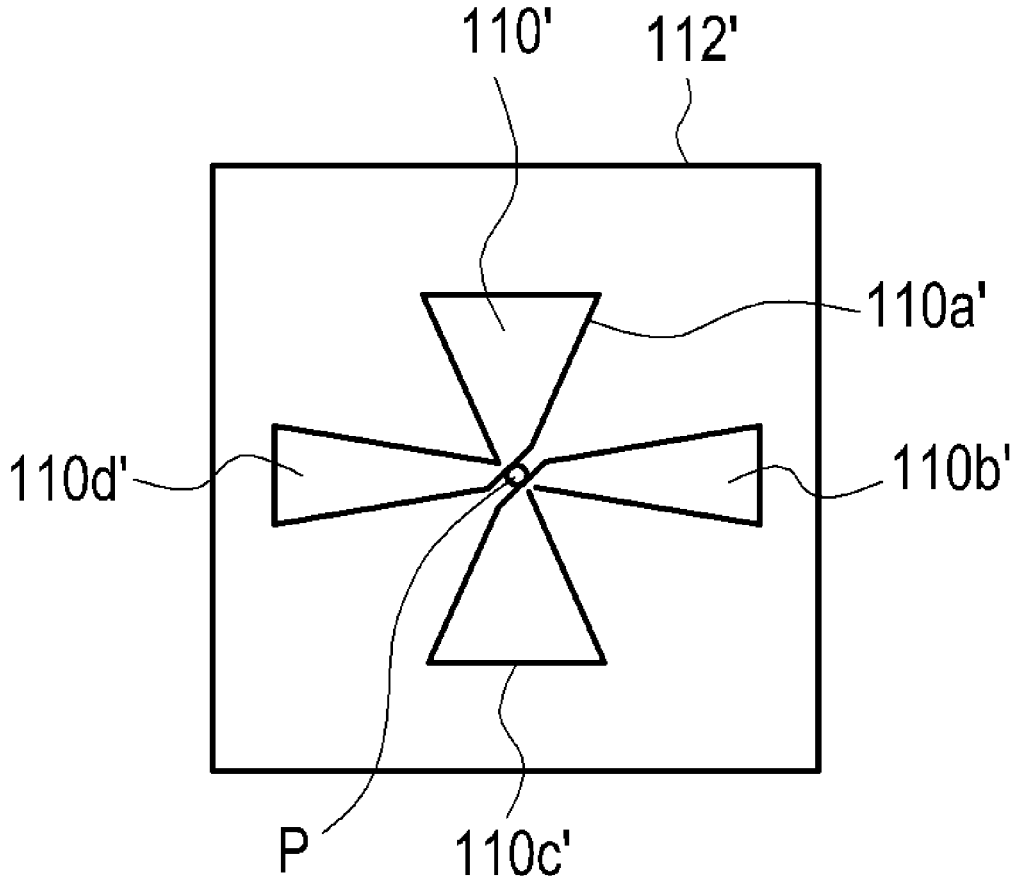
FIG. 21 is a view illustrating a structure of a radiation element array according to another embodiment of the present invention.

In the above description, it has been described that the four radiation arms of each radiation element are designed to have the same shape and to be symmetrical with each other in order to simplify the manufacturing process and to shorten the manufacturing time. However, the four radiation arms may be implemented in different shapes. For example, the structure of the radiation pattern 110' of the radiation element according to another embodiment of the present invention illustrated in FIG. 21 similarly has a structure in which a horizontal polarization dipole radiation unit having two radiation arms 110*d'* and 110*b'* and a vertical polarization dipole radiation unit having two radiation arms 110*a'* and 110*c'* are coupled to each other. At this time, it is illustrated that the radiation arms 110*d'* and 110*b'* of the horizontal polarization dipole radiation unit and the radiation arms 110*a'* and 110*c'* of the vertical polarization dipole radiation unit do not have the same shape. At this time, the two radiation arms 110*d'* and 110*b'* of the horizontal polarization dipole radiation unit may have the same shape. Likewise, the two radiation arms 110*a'* and 110*c'* of the vertical polarization dipole radiation unit may have the same shape. As described above, various modifications and changes may be made, and the scope of the present invention shall be determined based on the scope of the appended claims and the equivalents thereof, rather than based on above-described embodiments.

As described above, the omnidirectional antenna for a mobile communication service according to the present invention is capable of generating a +/−45 degree dual polarization while satisfying excellent omnidirectional radiation characteristics. Further, it is possible to implement the omnidirectional antenna with a small overall antenna size.

What is claimed is:

1. An omnidirectional antenna for a mobile communication service, the omnidirectional antenna comprising:

a plurality of radiation elements that are arranged at mutually regular intervals according to a predetermined angle in a horizontal direction from a reference point on a horizontal plane so as to emit beams, respectively, and a radiation element array including a feeding unit that distributes and provides feeding signals to each of the plurality of radiation elements, wherein each of the plurality of radiation elements includes a horizontal polarization dipole radiation unit having two radiation arms and a vertical polarization dipole radiation unit having two radiation arms, and wherein each of the plurality of radiation elements is configured in:

a first type in which one radiation arm of the horizontal polarization dipole radiation unit and one radiation arm of the vertical polarization dipole radiation unit are integrally provided as a pair, and the other radiation arm of the horizontal polarization dipole radiation unit and the other radiation arm of the vertical polarization dipole radiation unit are integrally provided as a pair, or a second type in which the one radiation arm of the horizontal polarization dipole radiation unit and the other radiation arm of the vertical polarization dipole radiation unit are integrally provided as a pair, and the other radiation arm of the horizontal polarization dipole radiation unit and the one radiation arm of the vertical polarization dipole radiation unit are integrally provided as a pair.

2. The omnidirectional antenna of claim 1, wherein a plurality of radiation elements arrays are successively arranged in a vertical direction.

3. The omnidirectional antenna of claim 1, wherein each of the plurality of radiation elements is provided in a pattern using a Flexible Printed Circuit Board (FPCB).

4. The omnidirectional antenna of claim 3, wherein the plurality of radiation elements are successively arranged on the FPCB at a predetermined interval, and the FPCB has a polyhedral or cylindrical shape.

5. The omnidirectional antenna of claim 1, wherein the radiation arms of the horizontal polarization dipole radiation unit and the radiation arms of the vertical polarization dipole radiation unit are simultaneously fed with power.

6. The omnidirectional antenna of claim 1, wherein at least two the radiation arms of the horizontal polarization dipole radiation unit have the same shape as at least two of the radiation arms of the vertical polarization dipole radiation unit.

7. The omnidirectional antenna of claim 6, wherein the radiation arms of the horizontal polarization radiation unit, which are integrally provided as a pair, and the radiation arms of the vertical polarization radiation unit, which are integrally provided as a pair, are provided symmetrically with each other.

8. The omnidirectional antenna of claim 6, wherein the radiation arms of the horizontal polarization dipole radiation unit have the same shape, and the radiation arms of the vertical polarization dipole radiation unit have the same shape.

9. The omnidirectional antenna of claim 1, wherein the number of the plurality of radiation elements is three.

10. The omnidirectional antenna of claim 2, wherein the plurality of radiation element arrays are arranged such that at least two or more radiation element arrays which generate the first polarization and the second polarization are arranged successively in the vertical direction, and the radiation element arrays having different polarizing directions are arranged in the same number to be symmetrical in polarity in the vertical direction.

11. The omnidirectional antenna of claim 10, wherein a distance between the radiation element arrays having different polarization directions is inversely proportional to the number of radiation element arrays.

12. The omnidirectional antenna of claim 2, wherein the plurality of radiation element arrays are constituted by radiation element arrays that generate first polarization and radiation element arrays that generate second polarized waves, the feeding unit that distributes and provides feeding signals to each of the plurality of radiation element arrays includes a plurality of feeding boards having a feeding pattern that provides a feeding signal to each of the plurality of radiation element arrays, the plurality of feeding boards are configured to be divided into a first type and a second type of which feeding signals have phase differences due to a difference between the feed patterns, and the first feeding boards and the second type feeding boards are alternately provided to the radiation element arrays that generate the same polarization.

13. The omnidirectional antenna of claim 2, wherein the plurality of radiation element arrays include radiation element arrays that generate a first polarization and radiation element arrays that generate second polarization, and the radiation element arrays that generate the same polarization are arranged with a predetermined difference in angle therebetween on the horizontal plane.

14. The omnidirectional antenna of claim 13, wherein the predetermined angle is 60 degrees.

15. The omnidirectional antenna of claim 2, wherein the feeding unit that distributes and provides feeding signals to each of the plurality of radiation element arrays includes a plurality of feeding boards having a feeding pattern that provides a feeding signal to each of the plurality of radiation element arrays, and each of the plurality of feeding boards includes:

an inner layer;

a feeding pattern formed on a top surface of the inner layer and having a plurality of coupling feeding patterns that respectively supply power to the plurality of radiation elements formed on a corresponding radiation element array in a coupling manner; and a ground pattern formed on a bottom surface of the inner layer.

16. The omnidirectional antenna of claim 15, wherein each of the plurality of feeding boards is fed with power through a plurality of feeding lines, respectively, at least one connection passage through which at least one of the feeding lines, which feed power to different feeding boards, passes is formed in a form of a through hole, and the feeding line passing through the connection path is soldered to the ground pattern.

* * * * *